US005762048A

United States Patent [19]

Yonekawa

[11] Patent Number: 5,762,048

[45] Date of Patent: Jun. 9, 1998

[54] FUEL SUPPLY SYSTEM WITH FUEL DUST REMOVING STRUCTURE

[75] Inventor: Masao Yonekawa, Kariya, Japan

[73] Assignee: Nippondenso Co., Ltd., Kariya, Japan

[21] Appl. No.: 607,206

[22] Filed: Feb. 26, 1996

[30] Foreign Application Priority Data

Mar. 20, 1995 [JP] Japan ..... 7-061310

[51] Int. Cl.[6] ..... F02M 37/04

[52] U.S. Cl. ..... 123/514; 123/510

[58] Field of Search ..... 123/456, 497, 123/509, 510, 514

[56] References Cited

U.S. PATENT DOCUMENTS

| | | | |
|---|---|---|---|
| 539,275 | 2/1895 | Laue et al. . | |
| 2,953,156 | 9/1960 | Bryant . | |
| 4,920,942 | 5/1990 | Fujimori | 123/497 |
| 5,078,167 | 1/1992 | Brandt et al. . | |
| 5,148,792 | 9/1992 | Tuckey | 123/514 |
| 5,195,494 | 3/1993 | Tuckey . | |
| 5,361,742 | 11/1994 | Briggs | 123/514 |
| 5,398,655 | 3/1995 | Tuckey | 123/514 |
| 5,469,829 | 11/1995 | Kleppner et al. | 123/514 |
| 5,471,959 | 12/1995 | Sturman | 123/497 |
| 5,483,940 | 1/1996 | Namba | 123/497 |
| 5,533,478 | 7/1996 | Robinson | 123/456 |

FOREIGN PATENT DOCUMENTS 6-173805 5/1994 Japan .

*Primary Examiner*—Carl S. Miller

*Attorney, Agent, or Firm*—Nixon & Vanderhye P.C.

[57] ABSTRACT

A fuel supply system of an internal combustion engine includes, a fuel return branch connection positioned downstream of a fuel filter. The branch connection returns part of the fuel which passed the fuel filter back into the fuel tank. An end of the fuel return connection is extended to the bottom of the fuel tank. A throttle part for controlling returned fuel flow is positioned in the branch connection. Because part of fuel which passed the fuel filter is returned into the fuel tank, fuel in the fuel tank is repeatedly filtered by the fuel filter. Thus, removal of dust in the fuel is improved and total fuel flow passing through the fuel pump is increased. This improves cooling of the fuel pump and thus helps prevent vapor generation while also improving durability of the pump.

13 Claims, 4 Drawing Sheets

FUEL SUPPLY SYSTEM WITH FUEL DUST REMOVING STRUCTURE

BACKGROUND OF THE INVENTION

1. Field of the Invention

The present invention relates to a fuel supply system with fuel dust removing structure, and more particularly to a fuel supply system of an engine having a fuel filter for removing dust, foreign particulate matters, debris or the like (hereinafter referred to as dust collectively) in fuel to be supplied from a fuel pump to a fuel injector.

2. Description of Related Art

In a fuel supply system disclosed in Japanese Patent Publication Laid-open No. 4-287861, a pressure regulator is installed in a path for supplying fuel from a fuel pump to a fuel injector, and a fuel filter is installed downstream of the pressure regulator to remove dust contained in the fuel which passed through the pressure regulator to be supplied to the injector. In this system, excess fuel fed from the fuel pump to the pressure regulator is returned from the pressure regulator to the fuel pump, so that pressure supplied to the injector is kept at a fixed or regulated pressure.

In the above-described construction, the fuel supply system has no return pipe which returns surplus fuel from a delivery pipe near the injector to the fuel tank. Therefore, the fuel passing only once through the fuel filter is injected from the injector with whatever fuel dust happens to be passed on one passage through the filter still. In practice, it is impossible to remove dust in the fuel fully (100%) when the fuel passes the fuel filter only one time. Thus, the dust that is not removed by the fuel filter on one pass will be fed to the injector with the fuel. Therefore, it may happen that an injection port of the injector becomes clogged with dust in the fuel, or the fuel leaks from the injection port because dust in the fuel is trapped within a needle valve which opens and closes the injection port.

In the above-described construction, since excess fuel fed from the fuel pump to the pressure regulator is returned from the pressure regulator to the fuel pump, it is possible to increase the fuel flow passing through the fuel pump to a value greater than that supplied to the injector. This can suppress a temperature rise of the fuel pump by the cooling effects of passing fuel. In this system, the pressure regulator is located upstream of the fuel filter. In a fuel supply system without such a pressure regulator, fuel pressure typically is detected by a fuel pressure sensor to control the rotating speed of a fuel pump for fuel pressure control. Because fuel flow passing through the fuel pump is thus reduced to become equal to fuel flow to the injector, the temperature of the fuel pump rises. Therefore, it may occur that vapor (bubble of evaporative fuel gas) is more likely to generate and thus may degrade durability of the fuel pump.

SUMMARY OF THE INVENTION

It is an object of the present invention to provide a fuel supply system which improves dust removal from fuel while simultaneously improving cooling of the fuel pump.

According to the present invention, fuel discharged from a fuel pump is passed through a fuel filter and supplied to a fuel consuming device such as an injector. However, part of fuel passed through the fuel filter is returned to the fuel tank through a return channel. Consequently, the fuel in the fuel tank passes through the fuel filter repeatedly. With increased number of passes through the fuel filter, the removal rate of dust in the fuel is increased. Further, by returning excess fuel which passed through the fuel filter into the fuel tank through the return channel, fuel flow passing through the fuel pump is made larger than fuel flow supplied to the fuel consuming device. This enhances the cooling effect of the fuel pump by increased passage of fuel and thus suppresses any temperature rise of the fuel pump.

Preferably, an open end of the return channel is extended downward to the bottom of the fuel tank to always keep the end of the return channel within storage fuel in the fuel tank. Thus, with the end of the return channel being always kept in the storage fuel, it prevents air in the fuel tank from being sucked to the fuel consuming device through the return channel. Further, since fuel is returned to the fuel tank by the return channel without dropping through air from its end, bubbling (vapor generation) of storage fuel in the tank is reduced.

More preferably, a throttle part is provided in the return channel to control the return flow. Although the restriction of return flow can be attained by using a small diameter (i.e., a thin) return channel passage, manufacture of such small diameter return channel becomes difficult and the return channel tends to clog. In this respect, by the use of the throttle part to control the return flow, it is easy to control the return flow and it is not needed to use such a small diameter return channel, thus simplifying manufacture and preventing clogging of the return channel.

DETAILED DESCRIPTION OF PREFERRED EMBODIMENTS

Figure 1:
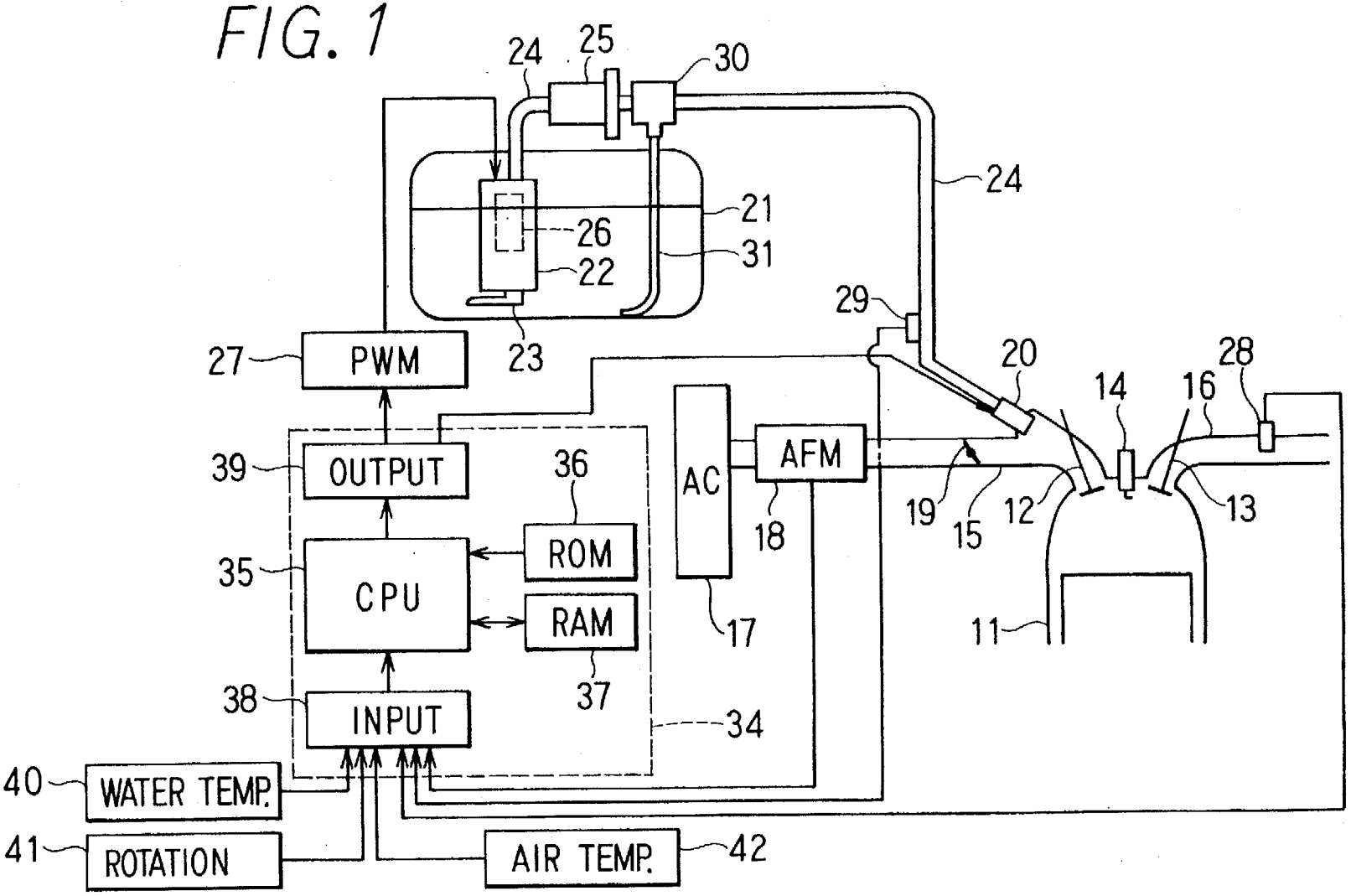
FIG. 1 is a schematic diagram showing the construction of an entire fuel supply system in accordance with a first embodiment of the present invention.

A fuel supply system in accordance with the first embodiment of the present invention is described below with reference to FIGS. 1 through 4 which illustrate application to an internal combustion engine. An internal combustion engine 11 having a plurality of cylinders comprises, for each cylinder, an intake valve 12, an exhaust valve 13, and an ignition plug 14. An intake pipe 15 and an exhaust pipe 16 are connected with the internal combustion engine 11. An air cleaner (AC) 17 is installed upstream the intake pipe 15. An air flow meter 18 (AFM) for detecting air flow which has passed through the air cleaner 17 is located downstream air cleaner 17. A throttle valve 19 is provided inside intake pipe 15 for air flow control. An injector 20 for each cylinder is mounted on the intake pipe such that throttle valve 19 is positioned upstream of the injector 20. An oxygen sensor 28 for detecting an oxygen concentration in the exhaust gas is installed downstream of the discharge pipe 16. A three-way catalyst (not shown) is positioned downstream the oxygen sensor 28.

A fuel tank 21 for storing fuel accommodates fuel pump 22 feeding fuel under pressure to injector 20 and a fuel filter 23 is positioned on the inlet side of fuel pump 22. A fuel pipe 24 connects the discharge port of fuel pump 22 and the injector 20 with each other. A fuel filter 25 of the high pressure type is mounted on the fuel pipe 24 at the output side of the fuel pump 22. The fuel pipe 24 has a nonreturn construction. That is, the fuel pipe 24 extends from the fuel tank 21 and terminates with a delivery pipe (not shown) for distributing the fuel to the injector 20.

A speed-variable DC pump motor 26 is included in the fuel pump 22 to drive fuel pump 22. In order to control the fuel discharge pressure of fuel pump 22, a PWM (pulse width modulation) circuit 27 is used to control an applied voltage to the speed-variable DC pump motor 26 for driving fuel pump 22. The PWM circuit 27 adjusts a voltage with the PWM system. An electronic control circuit 34 determines a mean power voltage that is determined by an ON/OFF duty ratio of the PWM signal.

Figure 2:
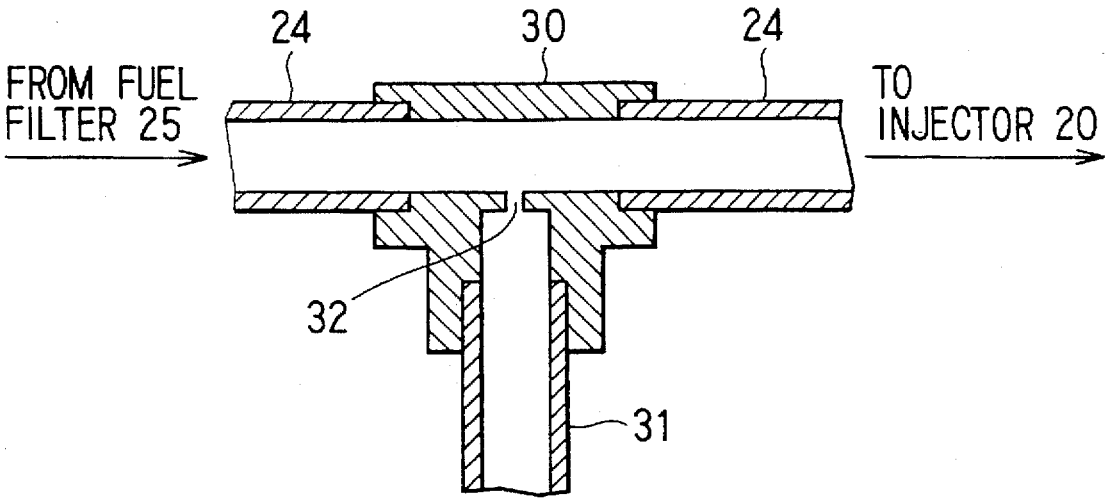
FIG. 2 is a sectional view of a connection between a fuel pipe and a return pipe.

A fuel pressure sensor 29 is mounted on fuel pipe 24 near injector 20 for detecting fuel pressure inside fuel pipe 24. A branch connection 30 mounted on fuel pipe 24 is positioned downstream of fuel filter 25. The branch connection 30 connects with return pipe 31 as a return channel, and a bottom end of return pipe 31 is extended vertically to the bottom of fuel tank 21. A part of the fuel which passed through fuel filter 25 is returned into fuel tank 21 by return pipe 31. As shown in FIG. 2, branch connection 30 is formed with a throttle part 32 reducing the channel area of return pipe 31 at a return entrance. The hole diameter of throttle part 32 is determined so that, when a regulated fuel pressure is kept around a target fuel pressure, the flow of fuel passed through throttle part 32 is kept at several (liters/hour) through ten (liters/hour).

The electronic control circuit 34 comprises a microcomputer having a CPU 35, ROM 36, RAM 37, and input/output interfaces 38 and 39. The electronic control circuit 34 reads information applied thereto from air flow meter 18, oxygen sensor 28, fuel pressure sensor 29, water temperature sensor 40 for detecting the temperature of engine-cooling water, rotation sensor 41 for detecting the crankshaft rotational angle of the engine 11, intake air temperature sensor 42 for detecting the temperature of intake air, and then calculates fuel injection quantity for the injector 20 and ignition timing of ignition plug 14.

Figure 4:
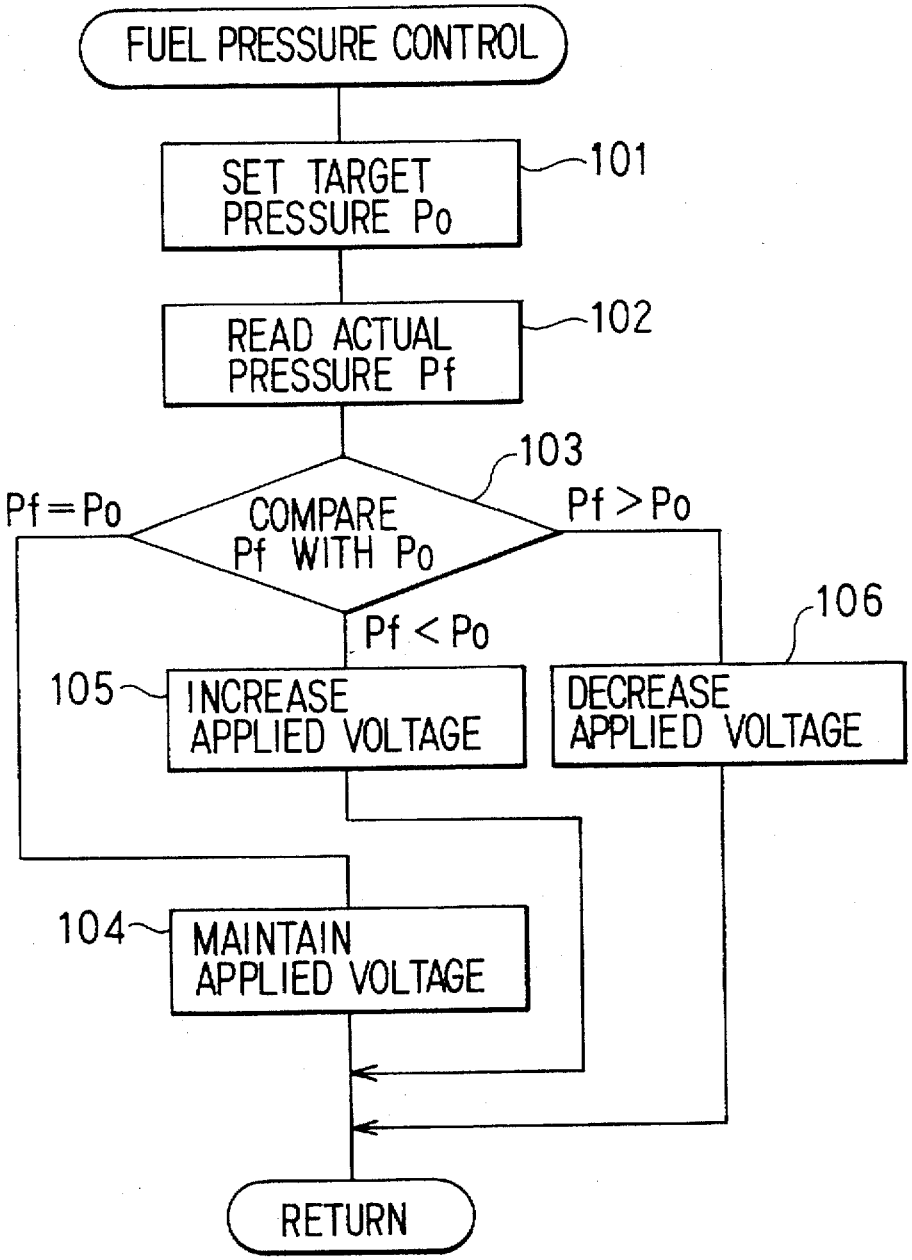
FIG. 4 is a flowchart showing the flow of the processing to be executed in a fuel pressure control routine.

As shown in FIG. 4, based on a fuel pressure control routine, the electronic control circuit 34 further controls the discharge pressure of fuel pump 22 for attaining a target fuel pressure. The fuel pressure control routine is executed repeatedly at an interval of a short-period. Upon start of the fuel pressure control, at step 101, a target fuel pressure Po is set in accordance with a car driving condition. At step 102, the electronic control circuit 34 reads an actual fuel pressure Pf outputted from fuel sensor 29. At step 103, actual fuel pressure Pf is compared with target fuel pressure Po. If actual fuel pressure Pf is equal to target fuel pressure Po, the program proceeds to step 104 at which the voltage applied to pump motor 26 of fuel pump 22 is maintained. Then, electronic control circuit 34 terminates execution of the routine.

If it is determined at step 103 that actual fuel pressure Pf is lower than target fuel pressure Po, the program proceeds to step 105 at which voltage applied to the fuel pump 22 is increased by electronic PWM control so as to increase the fuel discharge pressure of fuel pump 22 to correct fuel pressure until actual fuel pressure Pf becomes equal to target fuel pressure Po. Then, the electronic control circuit 34 terminates execution of the routine.

If it is determined at step 103 that actual fuel pressure Pf is higher than target fuel pressure Po, the program proceeds to step 106 at which voltage applied to the fuel pump 22 is decreased by electronic PWM control so as to decrease discharge pressure of the fuel pump 22 to correct fuel pressure until actual fuel pressure Pf becomes equal to target fuel pressure Po. Then, the electronic control circuit 34 terminates execution of the routine.

In the fuel supply system in accordance with first embodiment, because part of the fuel which passed through fuel filter 25 is returned to fuel tank 21 through return pipe 31, the fuel returned to fuel tank 21 passes repeatedly through fuel filter 25. As the number of times the fuel passes fuel filter 25, increases removal rate of dust from the fuel is improved. Thus, residual the dust which flows to the injector 20 without being removed by fuel filter 25 is remarkably decreased. As a result, clogging of the injection port of injector 20 and leakage of fuel through injector 20 caused by trapped dust are prevented.

Figure 3:
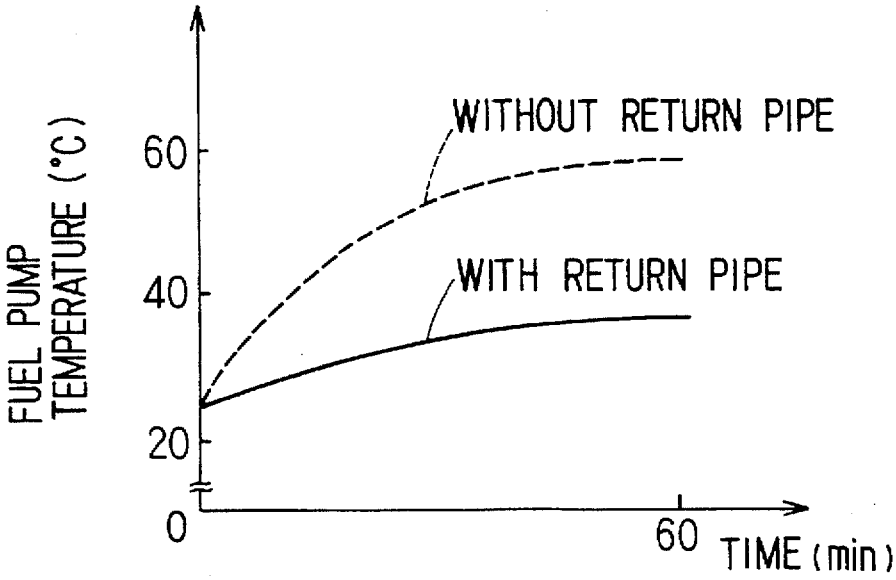
FIG. 3 is a graph showing a difference of the cooling effect between the cases in which the return pipe is used and not used.

Further, since excess fuel which passed through fuel filter 25 is returned into fuel tank 21 via return pipe 31, fuel flow passing fuel pump 22 can be made greater than the fuel flow (consumed fuel) supplied to injector 20. As a result, as shown in FIG. 3, the cooling effect on fuel pump 22 with return pipe 31 remarkably increases in comparison with no provision of return pipe 31. Since the cooling effect on fuel pump 22 can suppress its temperature rise, it is possible to prevent vapor from being generated by temperature rise of fuel pump 22 and to thus increase durability of fuel pump 22.

When the fuel level is lowered below the the bottom end of the return pipe, it is likely that air above the fuel in the tank 21 is sometimes sucked into injector 20 through return pipe 31. In addition, fuel dropping through air from the end of return pipe 31 collides with storage fuel in fuel tank 21 and bubbles the storage fuel to generate fuel vapor.

In this respect, in the fuel supply system in accordance with the first embodiment, because the bottom end of return pipe 31 is extended down to the bottom of fuel tank 21, it is always possible to keep the bottom end of return pipe 31 within the storage fuel of fuel tank 21. As a result, the bottom end of return pipe 31 is always filled with storage fuel. Thus, it is possible to prevent air in fuel tank 21 from being sucked into injector 20. Further, since fuel is returned from return pipe 31 into tank 21 without dropping onto the fuel, bubbling of storage fuel in fuel tank 21 can be prevented.

In the fuel supply system in accordance with the first embodiment, throttle part 32 is provided at the entrance of return pipe 31. Because throttle part 32 controls a return flow amount, it is easier to adjust return flow amount than in the case of adjustment by using a small diameter return pipe 31. Thus, the present invention can provide a fuel supply system in which manufacture is simple, return pipe 31 does not clog and reliability increases. Of course, the return flow amount may be controlled by using a small diameter return pipe 31, while still achieving objectives of the present invention.

Figure 5:
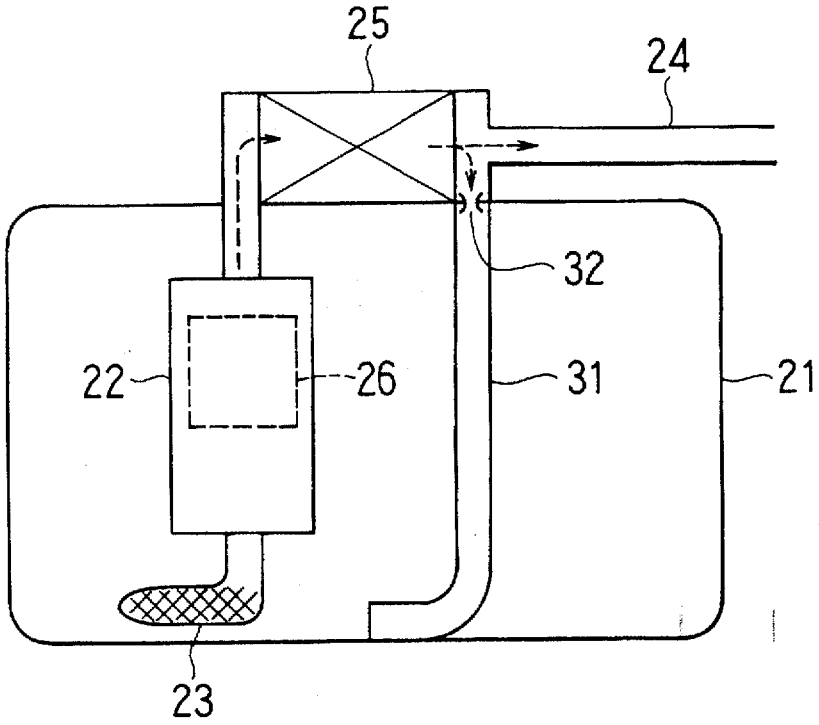
FIG. 5 is a sectional view of a fuel tank in accordance with a second embodiment of the present invention.

In the fuel supply system in accordance with the first embodiment, fuel filter 25 is located apart from fuel tank 21. As in the second embodiment shown in FIG. 5, however, fuel filter 25 may be fixed on fuel tank 21. In this embodiment, throttle part 32 is located downstream of fuel filter 25, and throttle part 32 connects with return pipe 31. The return pipe 31 extends to the bottom of the fuel tank 21 as in the first embodiment.

In the fuel supply system in accordance with the second embodiment, because part of fuel passing fuel filter 25 is returned from throttle part 32 to fuel tank 21 by return pipe 31, the second embodiment provides the same operational effects as the first embodiment. Besides, in the second embodiment, fuel filter 25 is integrated with fuel tank 21 and throttle part 32 is formed in the fuel filter 25 itself. Thus, construction can be simplified.

Figure 6:
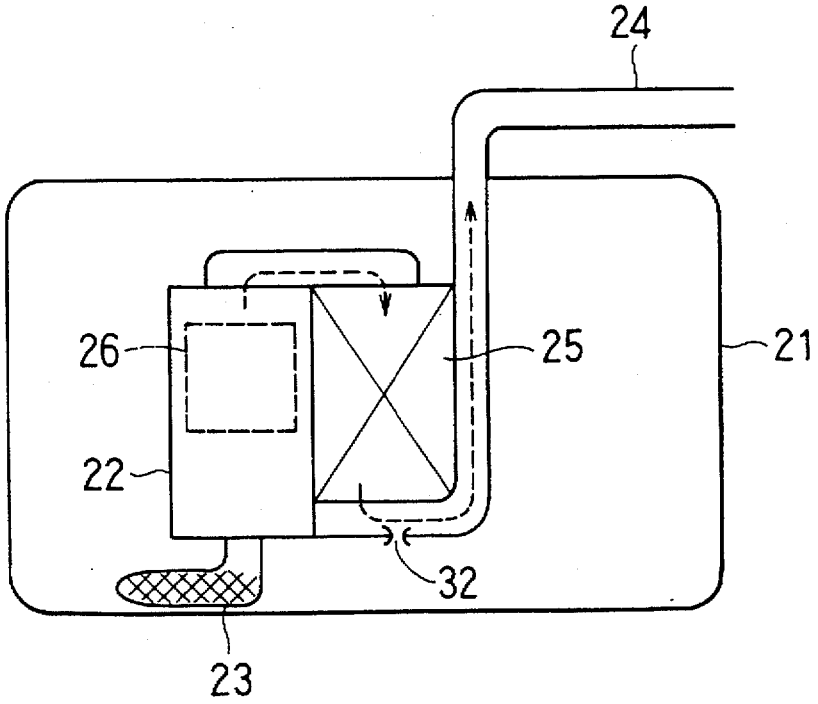
FIG. 6 is a sectional view of a fuel tank in accordance with a third embodiment of the present invention.

As shown in FIG. 6, in the fuel supply system in accordance the third embodiment, a fuel filter 25 is located within fuel tank 21 by integrating fuel filter 25 with fuel pump 22. In this embodiment, throttle part 32 is located downstream of the bottom of fuel filter 25 by drilling a hole in the fuel pipe 24, for instance. However, in third embodiment, with the downstream part of fuel filter 25 being located near the bottom of fuel tank 21, the fuel supply system does not necessitate a return pipe being connected to throttle part 32. That is, part of the fuel which passed fuel filter 25 is directly returned from throttle part 32 to fuel tank 21. Thus, the return channel is constructed only by throttle part 32, simplifying the fuel supply line.

In each embodiment, although the return channel or pipe 31 is installed downstream of fuel filter 25, it is also possible to install return pipe 31 at a center section of fuel filter 25, for example. Thus, even if fuel flows back through return pipe 31 from fuel tank 21 to fuel pipe 24 for some reason, fuel may be passed through at least a part of fuel filter 25 to remove dust.

Although in each embodiment, the voltage to pump motor 26 is controlled by PWM circuit 27, it can be controlled by a DC-DC converter.

According to the present invention, because part of fuel which passed the fuel filter is returned into the fuel tank through the return channel, the fuel in the fuel tank can be repeatedly filtered by the fuel filter. This can greatly increase removal of dust from the fuel. Further, because a larger amount of fuel now can be passed through the fuel pump, it is possible to increase its cooling effect on the fuel pump, thus preventing vapor occurrences which are likely to be caused by a temperature rise in the fuel pump. This can also increase durability of the fuel pump.

In addition, because the return channel is extended to open its discharge end at the bottom of the fuel tank, it is always possible to keep the return pipe within storage fuel in the fuel tank, and it is possible to prevent air in the fuel tank from being sucked through the return channel to the fuel consuming device. Besides, bubbling of storage fuel in the fuel tank by return fuel from the return channel can be effectively prevented.

Because the throttle part controls return flow, it may be adjusted with more ease than in the case of using a small diameter return pipe in its entire length. Thus, the return channel does not clog, and reliability of the fuel supply system is increased.

The present invention having been described should not be restricted to the above-described embodiments but may be modified in many other ways without departing from the spirit of the invention.

What is claimed is:

1. A fuel supply system having a fuel supply tank and a fuel injector for an internal combustion engine, the system comprising:

an electrically-operated fuel pump for supplying fuel stored inside the fuel supply tank at a predetermined fuel pressure;

a fuel supply path extending from the fuel pump to the injector;

a fuel filter installed in the fuel supply path; and a return channel connected at a position downstream of an inlet of the fuel filter and opening directly into the fuel supply tank for continuously returning a part of fuel passing through the filter back into the fuel supply tank during normal operating fuel pressures of the fuel supply system, wherein said return channel opens directly to the supply tank via a port, where said channel and port are sealed against sources of fuel external to the supply tank and fuel filter.

2. The fuel supply system as in claim 1, wherein the return channel opens at a bottom of the fuel supply tank.

3. The fuel supply system as in claim 1 further comprising:

a throttle part provided in an upstream side of the return channel for restricting fuel flow through the return channel.

4. The fuel supply system as in claim 1, wherein the return channel has an effective flow area restricting return fuel flow to a range from several to ten liters per hour.

5. The fuel supply system as in claim 1, further comprising:

a pressure sensor positioned downstream of the return channel to detect fuel pressure in the fuel supply path for controlling fuel pressure to a target fuel pressure.

6. The fuel supply system for a fuel consuming device, said system comprising:

a fuel supply tank for storing fuel therein;

a fuel pump positioned within the fuel supply tank for supplying pressurized fuel;

a fuel filter connected with the fuel pump for filtering the pressurized fuel;

a fuel pipe connecting the fuel filter to the fuel consuming device for supplying filtered fuel to the fuel consuming device; and a return channel provided in the fuel supply tank and directly opening at a bottom of the fuel supply tank for continuously returning a part of the filtered fuel back into the fuel supply tank at its bottom during normal operating fuel pressures of said system wherein said return channel opens directly to the supply tank, where said channel and port are sealed against sources of fuel external to the supply tank and fuel filter.

7. The fuel supply system as in claim 6, wherein the fuel pipe ends at the fuel consuming device and has no return passage from the fuel consuming device to the fuel supply tank.

8. The fuel supply system as in claim 6, wherein:

the fuel pipe is connected to a fuel injector of an engine as the fuel consuming device, and an upstream side of the return channel has an opening which restricts return flow of the filtered fuel to a range between several to ten liters per hour.

9. The fuel supply system as in claim 6, wherein:

the fuel filter is positioned in the fuel supply tank, the fuel pipe is connected at a bottom of the fuel filter, and an opening is formed at a bottom portion of the fuel pipe.

10. The fuel supply system as in claim 6 further comprising.

a branch connection formed with a throttle part through which the return channel is communicated with the fuel pipe, an opening area of the throttle part being smaller than that of the return channel.

11. A method for achieving improved fuel filtering and fuel pump cooling in a fuel supply system for an internal combustion engine, said method comprising the steps of:

pumping fuel from within a fuel supply tank and through a fuel supply conduit at a rate sufficient to maintain a predetermined fuel pressure at a remote fuel consuming device;

passing said fuel through a fuel filter before it is supplied to said fuel consuming device; and at normal operating fuel pressures, continuously returning a portion of at least partially filtered fuel back to the supply tank whereby fuel in the supply tank is repeatedly filtered and additional fuel pump cooling is caused by additional fuel flow required by said returning step, and wherein the filtered fuel is returned directly to the supply tank where said channel and port are sealed against sources of fuel external to the supply tank and fuel filter.

12. A method as in claim 11 wherein fuel is returned to the supply tank beneath a surface of fuel therein thus reducing fuel vaporization within the tank otherwise caused by returning fuel dropping through air located above the fuel.

13. A method as in claim 11 wherein returned fuel flow is controlled to a continuous flow rate in the range of several to the liters per hour by a localized flow restrictor disposed at an upstream side of a return flow conduit.

* * * * *